United States Patent [19]

Engel et al.

[11] 4,217,951

[45] Aug. 19, 1980

[54] CONTINUOUS CASTING STRAND GUIDE ROLLER

[75] Inventors: Kurt Engel, Leonding; Ronald Spannlang, Linz, both of Austria

[73] Assignee: Voest-Alpine Aktiengesellschaft, Linz, Austria

[21] Appl. No.: 857,792

[22] Filed: Dec. 5, 1977

[30] Foreign Application Priority Data

Dec. 10, 1976 [AT] Austria ..... 9122/76

[51] Int. Cl.[2] ..... B22D 11/12; B21B 31/08; B65G 13/00

[52] U.S. Cl. ..... 164/448; 29/124; 193/37

[58] Field of Search ..... 164/442, 448; 193/35 R, 193/35 B, 37; 308/20; 198/780, 789, 790, 791; 29/244, 116 R, 129, 124, 148.4 D, 148.4 S, 148.4 L; 226/109, 185, 186, 190

[56] References Cited

U.S. PATENT DOCUMENTS

| | | | |
|---|---|---|---|
| 2,294,098 | 8/1942 | Stromer | 29/124 |
| 3,263,284 | 8/1966 | Orr et al. | 164/448 X |
| 3,355,758 | 12/1967 | Clark | 29/124 X |
| 3,657,779 | 4/1972 | Granberry | 29/124 |
| 3,784,120 | 1/1974 | Harris | 29/124 X |
| 3,981,348 | 9/1976 | Schmucker | 164/448 X |

FOREIGN PATENT DOCUMENTS

| | | | |
|---|---|---|---|
| 1004167 | 1/1977 | Canada | 198/790 |

*Primary Examiner*—Richard B. Lazarus
*Assistant Examiner*—John S. Brown
*Attorney, Agent, or Firm*—Brumbaugh, Graves, Donohue & Raymond

[57] ABSTRACT

A strand guiding roller to be used in a continuous casting plant for supporting, bending, straightening and deforming a wide strand includes an axle, and a plurality of longitudinally divided rollers arranged on the axle and held thereon by bracing means.

6 Claims, 4 Drawing Figures

CONTINUOUS CASTING STRAND GUIDE ROLLER

BACKGROUND OF THE INVENTION

The invention relates to a strand guiding roller to be used in a continuous casting plant for supporting, bending, straightening and deforming a wide, continuously cast strand, in particular a steel slab, which roller is comprised of a plurality of roller bodies arranged on an axle.

It has been known to rotatably journal roller bodies on a stationary axle, which axle is supported at a number of places over its longitudinal extension. If one of the roller bodies is damaged or worn, the strand guiding roller must be removed from the continuous casting plant for exchanging that roller body. Subsequently, depending on the length and position of the roller body to be exchanged, a number of bearings on the roller must be pressed over bearing seat locations. This is a complicated process and one by which the bearing locations may easily be damaged. Because of the higher thermal wear to which the roller bodies arranged in the middle of the roller are subjected, these roller bodies usually must be removed and installed more frequently than the others so that the above-described disadvantages become more noticeable.

Furthermore, it has been known to support the strand by driven rollers comprised of roller bodies plugged one into the other, wherein the roller bodies each are provided with a shoulder acting as a bearing pin that extends into a recess in the neighboring roller and the bodies are held together by a bracing anchor penetrating all of the roller bodies. If in such a roller, a roller body is damaged, the roller must be removed and completely disassembled, which is complicated and time-consuming.

SUMMARY OF THE INVENTION

The invention aims at avoiding these disadvantages and difficulties and has as its object to provide a strand guiding roller of the above-defined kind, in which worn or damaged roller bodies can easily and quickly be exchanged without necessitating a complete disassembly of the strand guiding roller. In particular it is an object of the invention that with such a repair it shall not be necessary to remove and install the bearings of the roller as well as the intact roller bodies.

According to the invention, these objects are achieved in that the roller bodies are longitudinally divided into at least two segments each surrounding the axle by 180° at the most. These segments are held relative to each other or on the axle by bracing means.

If the roller bodies are divided into segments along planes extending through the axes of the roller bodies, the segments can be produced in a simple manner by sawing in half a roller body blank initially produced as a whole.

According to another embodiment, the roller bodies are divided into segments along planes that enclose an acute angle with the axis, which design results in a favorable distribution of load over the segments while the load moves from segment to the other one.

If the strand guiding roller is to be drivable, advantageously at least one segment is secured against rotation relative to the axle by a catch connection.

A further embodiment is characterized in that the segments are supported relative to the axle by bearings.

In order for the segments to be supported on the axle or on the bearings without play, an air gap is provided between the segments of a roller body. Thereby a play between the segments and the axle or between the segments and the bearings, respectively, which play would cause knocking (wobbling) of the roller body, is certainly avoided.

In order that cinders, dirt and other impurities or cooling water, respectively, cannot penetrate from the outside to the roller axle, the oppositely arranged side faces of the segments are provided with sealings extending over the lengths of the segments.

BRIEF DESCRIPTION OF THE DRAWINGS

The invention shall now be described in more detail by way of a number of embodiments and with reference to the accompanying drawing, wherein.

DESCRIPTION OF EXEMPLARY EMBODIMENTS

Figure 1:
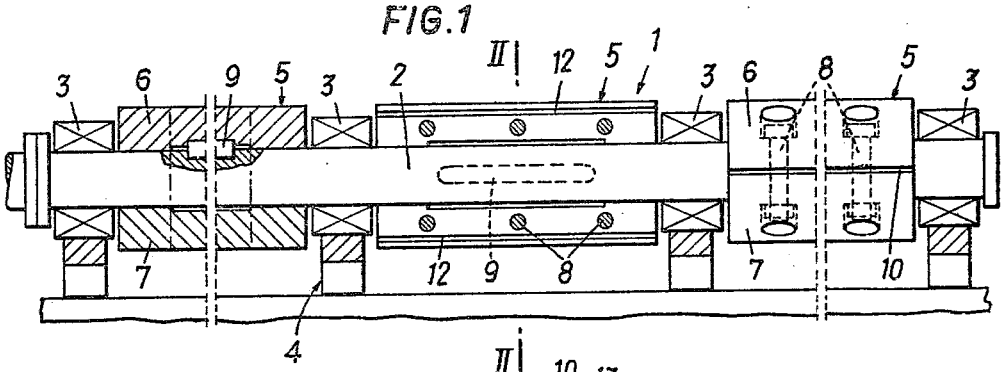
FIG. 1 is a longitudinal section through a strand guiding roller according to the invention.
Figure 2:
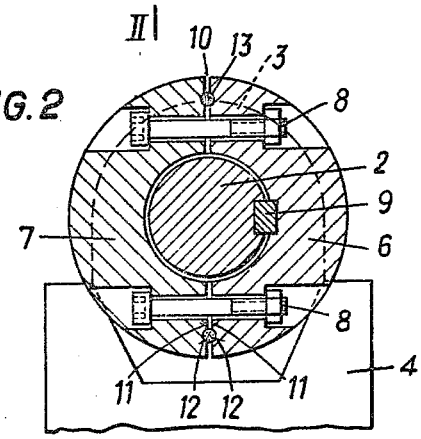
FIG. 2 is a section along line II—II of FIG. 1 according to another embodiment.

According to FIG. 1, the axle 2 of a strand guiding roller 1 is journaled in a schematically illustrated supporting construction 4 by four bearings 3 evenly distributed over the longitudinal extension of the strand guiding roller. Between the bearings, roller bodies 5 are arranged on the axle. Each one of the roller bodies 5 is divided along a plane extending through its axis and thus includes two half-shells 6 and 7, held together by screws 8 sunk into them. One of the two half-shells of each roller body is secured against rotation relative to the axle by a feather key 9 or other catch connection. If one of the roller bodies of a strand guiding roller has to be exchanged because it is worn or damaged, the bearings 3 need not be taken off the axle. Only the screws of the roller body to be exchanged have to be detached, whereupon the half-shells can be removed in a direction perpendicular to the axle and exchanged for intact ones. Theoretically speaking, the roller need not be removed at all from the continuous casting plant for an exchange of a roller body. The screws can be detached in a simple manner by torch cutting. The remaining intact roller bodies of the strand guiding roller are not affected by the roller body exchange, i.e. they can remain on the axle where they are, just like the bearings 3.

In order to ensure that the segments of a roller body are pressed against the axle by the screws 8, an air gap 10 is provided between the segments of a roller body so that the segments do not contact one another. This air gap is formed by the width of the saw cut when sawing up the roller body blank into two half-shells. In order to prevent dirt, cinders or cooling water from penetrating to the axle, each one of the oppositely arranged side faces 11 of the segments is provided with a groove 12 for accommodating a sealing string 13 of asbestos. As a sealing material a ledge of non-ferrous metal can also be provided.

The axle of the roller can be driven in a known manner so that this roller can also be used as a driving roller.

Figure 3:
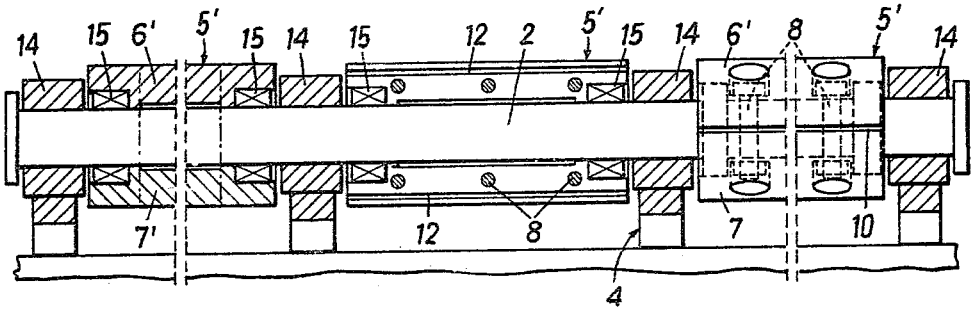
FIG. 3 shows another embodiment of a strand guiding roller in an illustration analogous to that of FIG. 1.

In the embodiment illustrated in FIG. 3, the axle 2 is rigidly secured to the supporting construction 4 by four axle holders 14, while the roller bodies 5' are rotatably journaled relative to the axle via bearings 15. The roller bodies are also divided into two half-shells 6' and 7' along a plane and supported on the axle via bearings 15. Again an air gap ensures that the roller bodies do not wobble on the bearings but sit tightly and without play on the bearings.

Figure 4:
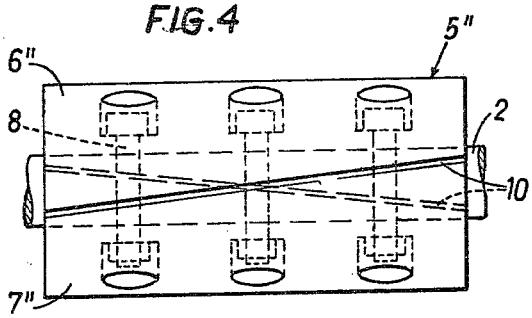
FIG. 4 is a side view of a further embodiment.

FIG. 4 illustrates an embodiment of the roller according to the invention, in which the roller body 5'' is divided along a plane which is inclined relative to the axis by an acute angle. In order that the segments can still be installed and removed in the radial direction, the inner edge formed by the plane is chamfered.

The invention is not limited to the exemplary embodiments, but can be modified in various respects. Thus it is also possible to divide the roller bodies into more than two segments. It would also be possible to provide the partition of the roller bodies by helical faces.

What we claim is:

1. A strand guiding roller of a continuous casting plant adapted for supporting, bending, straightening and deforming a wide, continuously cast strand, said roller comprising:

an axle;

a plurality of roller bodies arranged on said axle, each one of said plurality of roller bodies being longitudinally divided into at least two segments along a plane that encloses an acute angle with the axis of the respective roller body, each one of said at least two segments surrounding said axle by 180° at the most; and bracing means for holding said at least two segments on said axle.

2. A strand guiding roller as set forth in claim 1, wherein said bracing means comprise screw bolts arranged in recesses in said roller body outer faces, said recesses being transverse to said axle, and said screw bolts extending from a recess in one segment to a recess in its corresponding segment.

3. A strand guiding roller, of a continuous casting plant adapted for supporting, bending, straightening and deforming a wide, continuously cast strand, said roller comprising:

an axle;

a plurality of roller bodies arranged on said axle, said plurality of roller bodies being longitudinally divided to form at least two segments, each of said at least two segments surrounding said axle by less than 180° so that an air gap is provided between said two segments and they do not touch; and bracing means for holding said at least two segments on said axle.

4. A strand guiding roller as set forth in claim 3, wherein said bracing means comprise screw bolts arranged in recesses in said roller body outer faces, said recesses being transverse to said axle, and said screw bolts extending from a recess in one segment to a recess in its corresponding segment.

5. A strand guiding roller of a continuous casting plant, adapted for supporting, bending, straightening and deforming a wide, continuously cast strand, said roller comprising:

an axle;

a plurality of roller bodies arranged on said axle, said plurality of roller bodies being longitudinally divided to form at least two segments, said at least two segments having oppositely arranged side faces, each one of said at least two segments surrounding said axle by 180° at the most;

seals provided on said oppositely arranged side faces and extending therealong; and bracing means provided for holding said at least two segments on said axle such that the seals close any space between the side faces.

6. A strand guiding roller as set forth in claim 5 wherein said bracing means comprise screw bolts arranged in recesses in said roller body outer faces, said recesses being transverse to said axle, and said screw bolts extending from a recess in one segment to a recess in its corresponding segment.

* * * * *